United States Patent [19]

Wagner et al.

[11] Patent Number: 4,658,592

[45] Date of Patent: Apr. 21, 1987

[54] SINGLE-LOOP, RANKINE-CYCLE POWER UNIT WITH SUPERSONIC CONDENSER-RADIATOR

[75] Inventors: William R. Wagner, Los Angeles; Stanley V. Gunn, Chatsworth, both of Calif.

[73] Assignee: Rockwell International Corporation, El Segundo, Calif.

[21] Appl. No.: 770,903

[22] Filed: Aug. 30, 1985

[51] Int. Cl.[4] ..... F01K 9/00

[52] U.S. Cl. ..... 60/689; 60/671; 60/685; 62/DIG. 1; 165/110

[58] Field of Search ..... 60/645, 651, 670, 671, 60/685, 689, 692, 693, 694; 165/41, 110; 62/DIG. 1; 244/163

[56] References Cited

U.S. PATENT DOCUMENTS

| | | | |
|---|---|---|---|
| 4,089,177 | 5/1978 | Olofsson | 60/689 X |
| 4,307,573 | 12/1981 | King | 60/693 X |
| 4,572,285 | 2/1986 | Botts et al. | 165/41 X |

OTHER PUBLICATIONS

Pietsch, A. and Trimble, S., "Space Station Brayton Power System", published in Proceedings of 20th Intersociety Energy Conversion Conference, *Society of Automotive Engineers, Inc.*, 859154, pp. 1.119–1.124, Aug. 1985.

Chandoir, D. W., et al, "A Solar Dynamic ORC Power System for Space Station Applications, published in Proceedings of 20th Intersociety Energy Conversion Conf., *Society of Automotive Engineers, Inc.*, 859085, pp. 1.58–1.64.

*Primary Examiner*—Stephen F. Husar

*Attorney, Agent, or Firm*—H. Fredrick Hamann; Harry B. Field; Lawrence N. Ginsberg

[57] ABSTRACT

A closed Rankine-cycle power unit 10 for powering a turbine 16. The unit comprises a single closed loop in which a working fluid is circulated. The fluid, in liquid phase, is brought to gaseous phase by passing it through a heat exchanger 14 and the gas is used to drive a turbine 16. The gas is then passed through supersonic condenser 20 of supersonic condenser-radiator 18. Supersonic condenser 20 comprises a supersonic DeLaval nozzle 30 connected to a long barrel 38 which converts the gas stream into liquid droplets. The droplets are formed into a droplet beam 22 by a spray nozzle 40, the droplets radiating away a large amount of their heat energy. The beam 22 is collected as a liquid by a collector 24 and pumped through a compressor 26 which raises its pressure. The liquid from the compressor 26 is then circulated through the heat exchanger 14 again.

8 Claims, 3 Drawing Figures

SINGLE-LOOP, RANKINE-CYCLE POWER UNIT WITH SUPERSONIC CONDENSER-RADIATOR

BACKGROUND OF THE INVENTION

1. Field of the Invention

This invention relates to a single-loop, Rankine-cycle power unit and, more particularly, to such a power unit which employs a supersonic condenser-radiator and is especially adapted to space application.

2. Description of the Prior Art

A power unit which has been designed for use in space applications is a closed Brayton cycle unit with a pair of heat exchangers and a heat radiator as shown in FIG. 1. A heat source heats the primary working fluid (e.g., a He mixture) in a heat exchanger before the fluid is fed to a turbine. The exhaust gas from the turbine is then cooled down in a second heat exchanger before being fed to a compressor to raise its pressure. A second working fluid (e.g., Dow 705) is pumped through the second heat exchanger where it absorbs heat from the first working fluid and is then passed through a liquid droplet radiator (or other type radiator) which removes its heat energy. The problem with this arrangement is that a very large second heat exchanger and fluid system is required. This unit is bulky, heavy and, because of its size, subject to meteorite damage and possible failure by leakages over a 20-year cyclic life period in space.

OBJECTS OF THE INVENTION

An object of this invention is to reduce the size, complexity, weight and vulnerability to damage of the double-loop Brayton-cycle power unit now used in space applications and to improve overall system reliability.

Other objects, advantages and novel features of the present invention will become apparent from the following detailed description of the invention when considered in conjunction with the accompanying drawings.

SUMMARY OF THE INVENTION

The present invention is directed toward a closed Rankine-cycle power unit in which a single working fluid is circulated around a single loop. The loop, in part, includes a heat exchanger and a heat source. The heat source provides heat energy to the heat exchanger for converting the working fluid from liquid to gaseous phase. A turbine is connected to receive the gas from the heat exchanger and to be driven thereby. A supersonic gas condenser combined with a liquid droplet radiator is utilized for receiving and condensing the working fluid of the turbine into liquid droplets, forming a spray beam of droplets which radiate heat, and collecting the cooled droplets as a liquid. The liquid fluid is then sent through a pump and compressor, raising the fluid's pressure to a high value and returning the liquid to the heat exchanger, thus completing the loop.

BRIEF DESCRIPTION OF THE DRAWINGS

The same elements or parts throughout the figures of the drawing are designated by the same reference characters.

DETAILED DESCRIPTION OF THE PREFERRED EMBODIMENTS

Figure 2:
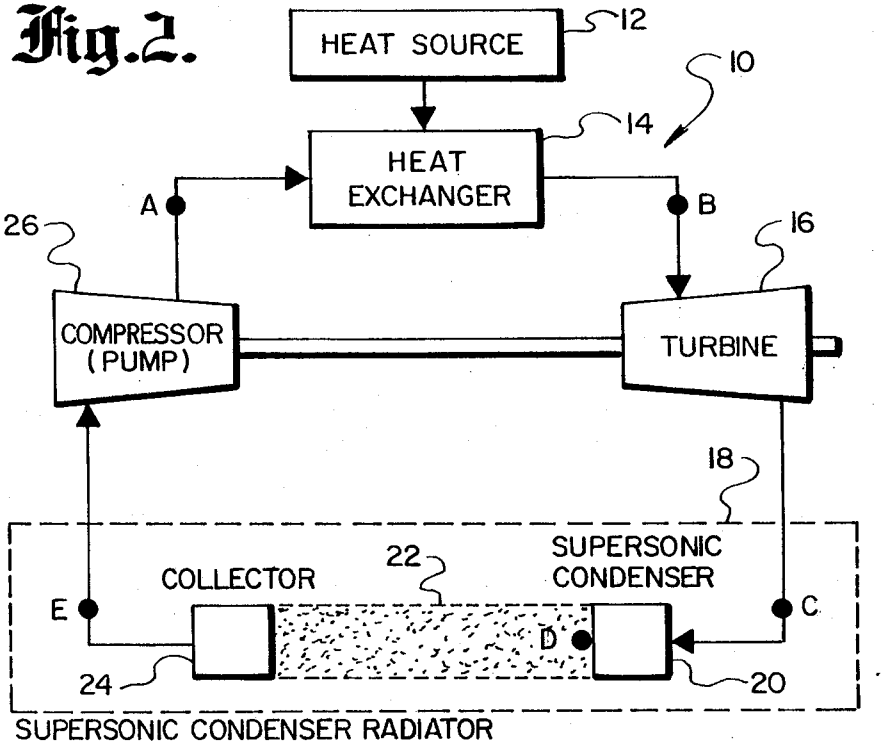
FIG. 2 is a schematic diagram of a single-loop, closed Rankine-cycle power unit in accordance with the invention.
Figure 1:
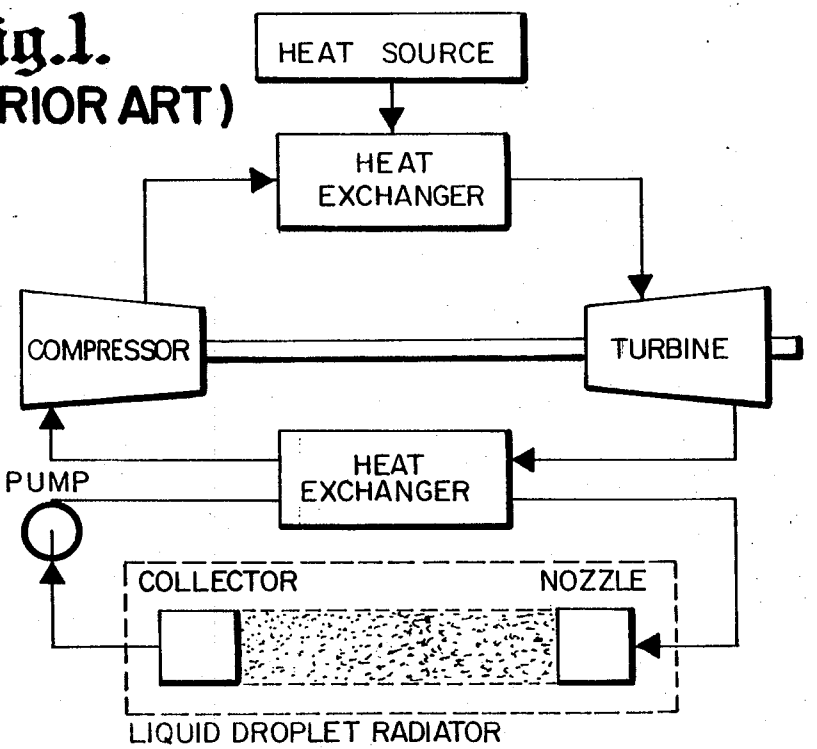
Fig. 1. (PRIOR ART)
FIG. 1 is a schematic diagram of a closed Brayton-cycle power unit.

FIG. 2 is a schematic illustrating an embodiment of the present invention. As can be seen, the second heat exchanger of the prior art Brayton-cycle power unit is eliminated, as is also the second loop. What is employed is a closed Rankine-cycle, single-loop power unit 10 with a liquid droplet radiator 18 which employs a novel supersonic condenser 20. Liquid droplet radiator 18, is therefore, hereinafter, more specifically referred to as supersonic condenser-radiator 18. The working fluid in the system may, for example, be ethylene glycol, water mixtures, glycerin or liquid metals such as liquid mercury, Na, K, Li, or hydrocarbons such as toluene. The liquid is heated to its gaseous state by passing it through a heat exchanger 14 which derives its heat energy from a heat source 12 which may, for example, depend on solar panels or nuclear sources. Thus, hot high-pressure gas leaves the heat exchanger (point B) and drives the turbine 16. Coming out of the turbine 16 the working fluid is basically gaseous but may have a small quantity of liquid droplets mixed in with the gas (partial-condensing turbine).

The gaseous mixture is now passed through a supersonic condenser 20 which drops its temperature and pressure still lower so that a cloud of liquid droplets is formed and the gas content is essentially eliminated. This cloud of droplets is sprayed out through a nozzle 30 (see FIG. 3) as a droplet beam 22 which radiates a considerable amount of heat during flight and the droplets are accumulated in a collector 24. The working fluid in the collector 24 is in the suitable form of a liquid which flows to a compressor (and pump) unit 26 which raises it to a high pressure again.

Typical pressures and temperatures at various points in the loop are as follows:

| | | |
|---|---|---|
| point "A" | 1700 psia | 510° R |
| point "B" | 1500 psia | 2000° R |
| point "C" | 1.00 psia | 900 ° R |
| point "D" | 0.01 psia | 700° R |
| point "E" | 0.1 psia | 500° R |

Figure 3:
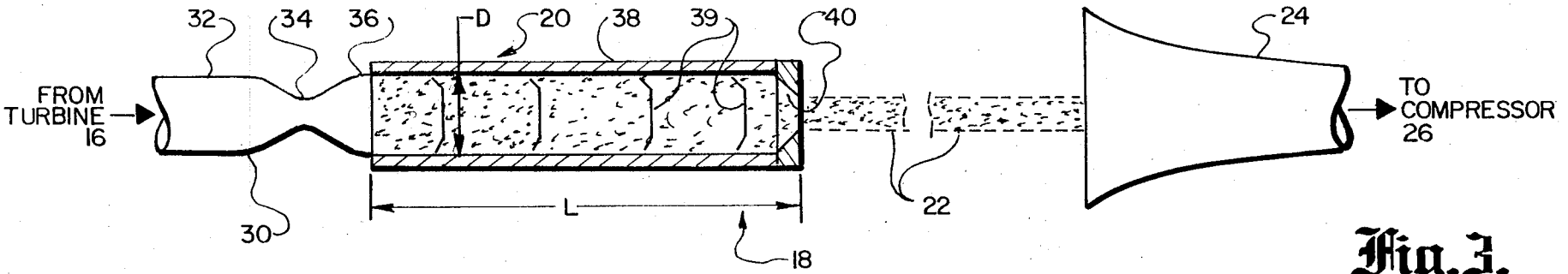
FIG. 3 is a schematic diagram of a supersonic condenser-radiator in accordance with the invention.

The novel supersonic condenser 20 employed in this novel power unit combination is shown in FIG. 3. The gaseous output from the turbine 16 is fed to a supersonic DeLaval nozzle 30 with a subsonic section 32, a narrow throat, or choke, section 34 and a supersonic nozzle section 36. The subsonic section 32 preferably is gimballed about two orthogonal axes. The throat section 34 increases the velocity of the gaseous stream to supersonic velocity so that its pressure and temperature drop. The stream is fed by the supersonic nozzle 36 into a long finned barrel section 38 where it completes condensation into liquid droplets by a condensing shock array 39. The length-to-inner-diameter ratio (L/D) of the barrel section should be high, e.g., greater than or equal to 10, to provide a full opportunity for complete droplet formation. A seed material of fine particulate (micron size) may be provided in the working fluid to ensure droplet evolution and uniformity and for radiation purposes.

The droplets are sprayed out of a spray nozzle 40 across an intervening space between the spray nozzle 40 and collector 24 and finally into collector 24. The nozzle 40 forms a shaped droplet, or spray, beam 22. This power unit is particularly adapted for use in outer space. When the droplets are sprayed out of the spray nozzle 40 in this outer space environment, heat is radiated and the temperature of the droplets is lowered.

What has been described herein is a novel single-loop closed Rankine-cycle power unit utilizing a novel supersonic condenser as a heat radiator.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A supersonic condenser-radiator for converting a subsonic flow of gaseous working fluid into a liquid comprising:

a supersonic DeLaval nozzle connected to receive said subsonic flow of gaseous working fluid and convert it to a supersonic gaseous flow;

barrel means connected to said nozzle for receiving said supersonic gaseous flow and converting it into a multitude of liquid droplets;

spray nozzle means attached to said barrel for forming a beam from said liquid droplets; and, collector means for receiving said droplet beam and cohering said droplets into a liquid.

2. A radiator as in claim 1, wherein:

the length-to-inner-diameter ratio of said barrel is equal to or greater than 10:1.

3. A closed Rankine-cycle, single-loop power unit in which a working fluid is circulated around said single loop comprising:

a heat exchanger:

a heat source for providing heat energy to said heat exchanger for converting said working fluid from liquid to gaseous phase;

a turbine connected to receive a gas from said exchanger and to be driven thereby;

liquid droplet radiator means for receiving and condensing the working fluid output of said turbine into liquid droplets, forming a spray beam of said droplets, and collecting said droplets as a liquid, said liquid droplet radiator means including a supersonic DeLaval nozzle connected to receive the output gas mixture from the turbine and convert it to a supersonically flowing stream; and pump and compressor means for circulating said liquid working fluid through said loop, raising its pressure to a high value and returning the liquid to said heat exchanger.

4. A power unit as in claim 3, wherein the liquid droplet radiator further comprises a long barrel attached to receive the supersonic stream from the DeLaval nozzle, the gaseous stream completing the transformation in the barrel into a multitude of liquid droplets.

5. A power unit as in claim 4, wherein the liquid droplet radiator further comprises:

a spray nozzle attached to the barrel for forming said droplets emerging from said barrel into a spray beam, wherein said droplets lose heat energy by cloud radiation to the environment.

6. A power unit as in claim 4, wherein:

the length-to-inner-diameter ratio of said barrel is equal to or greater than 10:1.

7. A power unit as in claim 5, wherein said liquid droplet radiator further comprises:

collector means for collecting the droplets of the spray beam and converting them into a liquid.

8. A power unit as in claim 7, further including:

a fine particulate seed element employed in said working fluid to aid coalescence of said droplets into fine uniform sizes.

* * * * *